US008978532B2

(12) United States Patent
Canedo Duarte da Rocha et al.

(10) Patent No.: US 8,978,532 B2
(45) Date of Patent: Mar. 17, 2015

(54) CUT-RESISTANT JACKET FOR TENSION MEMBER

(71) Applicant: WireCo WorldGroup Inc., Kansas City, MO (US)

(72) Inventors: José António Canedo Duarte da Rocha, S. Félix da Marinha (PT); João Manuel Morais de Sousa, Matosinhos-Porto (PT)

(73) Assignee: WireCo Worldgroup Inc., Kansas City, MO (US)

( * ) Notice: Subject to any disclaimer, the term of this patent is extended or adjusted under 35 U.S.C. 154(b) by 53 days.

(21) Appl. No.: 13/850,960

(22) Filed: Mar. 26, 2013

(65) Prior Publication Data

US 2013/0247534 A1 Sep. 26, 2013

Related U.S. Application Data

(60) Provisional application No. 61/615,738, filed on Mar. 26, 2012.

(51) Int. Cl.

| | |
|---|---|
| ***D04C 1/12*** | (2006.01) |
| ***D07B 1/00*** | (2006.01) |
| ***D07B 1/06*** | (2006.01) |

(Continued)

(52) U.S. Cl.

CPC ..... *D07B 1/005* (2013.01); *D07B 1/0613* (2013.01); *D07B 1/064* (2013.01); *D07B 5/00* (2013.01); *D07B 1/02* (2013.01); *D07B 1/025* (2013.01); *D07B 2201/1092* (2013.01); *D07B 2201/209* (2013.01); *D07B 2201/2092* (2013.01); *D07B 2201/2095* (2013.01); *D07B 2205/2042* (2013.01); *D07B 2205/3025* (2013.01); *D07B 2401/2015* (2013.01); *D07B 2401/2075* (2013.01); *D07B 2501/2038* (2013.01); *D07B 2501/2061* (2013.01)

USPC ..... 87/6

(58) Field of Classification Search

USPC ..... 57/210, 212, 220, 222, 223, 232; 87/1, 87/6, 8, 9, 13

See application file for complete search history.

(56) References Cited

U.S. PATENT DOCUMENTS

| | | | | |
|---|---|---|---|---|
| 3,395,530 | A | 8/1968 | Campbell | |
| 4,640,179 | A * | 2/1987 | Cameron | 87/6 |

(Continued)

FOREIGN PATENT DOCUMENTS

| | | | |
|---|---|---|---|
| WO | 2011083126 | A1 | 7/2011 |
| WO | 2011154415 | A1 | 12/2011 |

*Primary Examiner* — Shaun R Hurley

(74) *Attorney, Agent, or Firm* — Husch Blackwell LLP

(57) ABSTRACT

A rope having a cut-resistant jacket which includes a core comprised of a plurality of sub-ropes. The sub-ropes may be in a parallel strand configuration. The sub-ropes and the strands thereof may be made of fibers of a synthetic material, such as polyester, nylon, polypropylene, polyethylene, aramids, or acrylics. A cut-resistant jacket surrounds the core and is made from a material that has increased strength and/or abrasion resistance over the material of the core. The cut-resistant jacket may comprise steel wires and may further comprise braided steel wires or rope. The braided steel wires or rope may be covered with a plastic material for increased corrosion resistance. A filter layer may be disposed between the core and the cut-resistant jacket and may be wrapped around an outer surface of the core prior to the cut-resistant jacket being formed.

6 Claims, 3 Drawing Sheets

(51) Int. Cl.
*D07B 5/00* (2006.01)
*D07B 1/02* (2006.01)

(56) References Cited

U.S. PATENT DOCUMENTS 4,886,691 A * 12/1989 Wincklhofer ..... 428/68
4,887,422 A 12/1989 Klees et al.
5,301,595 A * 4/1994 Kessie ..... 87/6
7,137,483 B2 11/2006 Kato et al.
8,176,718 B2 * 5/2012 Ridge et al. ..... 57/212
2003/0005681 A1 * 1/2003 He et al. ..... 57/210
2004/0069132 A1 4/2004 Knudsen et al.
2009/0282801 A1 * 11/2009 Gilmore ..... 57/237
2013/0145740 A1 * 6/2013 Schulz ..... 57/231

* cited by examiner

CUT-RESISTANT JACKET FOR TENSION MEMBER

CROSS-REFERENCE TO RELATED APPLICATIONS

This application claims the benefit of U.S. Provisional Application No. 61/615,738 filed Mar. 26, 2012, the entire disclosure of which is incorporated herein by reference.

BACKGROUND OF THE INVENTION

1. Field of the Invention

The present invention is directed toward a synthetic rope that includes a core surrounded by a cut-resistant jacket. One embodiment of the present rope may be used for mooring off-shore oil rigs wherein the cut-resistant jacket resists the cutting action of trawling lines used in the commercial fishing industry.

2. Background Art

Deep-water off-shore platforms for oil drilling often use high-strength polyester deep-water mooring ropes to tether the platform to the ocean floor. The strength-to-weight ratio of the polyester rope is very desirable because the mooring ropes may be thousands of feet in order to reach the ocean floor. Thus, installing, transporting, moving, or otherwise maneuvering the mooring ropes proves very burdensome and dangerous if heavier mooring rope is used. As such, polyester mooring rope is very desirable for use in mooring oil platforms to the ocean floor because of its lighter weight and substantial strength.

However, while the use of polyester mooring rope is widespread throughout the off-shore oil drilling industry, an unsolved need has been identified by off-shore platform operators. Off-shore oil platforms are often located in the middle of the ocean and these platforms also share the ocean with commercial fishing vessels. Commercial fishing vessels often employ a popular method of commercial fishing called trawling. Trawling involves dragging a trawl that comprises a structure and a net being drug through the water behind one or more boats. Trawling may be performed at full-depth wherein the trawl is drug along the ocean floor or at mid-depth where the trawl is drug through the water at a depth where fish have been located. Mid-depth trawling may include selecting the depth of the trawl based upon a measured depth of fish obtained by radar or other method now known or hereafter developed.

Because a trawl may be dragged a long distance behind a fishing boat, the trawling gear behind the boat may come into contact with the off-shore platform mooring ropes as the boat(s) navigate around the platform(s). Polyester mooring ropes are often sliced or severely damaged by the trawl gear being dragged through the water when the wire rope or other rope of the trawl is dragged across one area of the mooring rope, which results in abrasion cutting similar to a slicing knife. It is difficult to determine if the mooring ropes are damaged unless the ropes are detached and brought to the surface for testing. In addition to the costs of replacing the mooring rope, the slicing or damage to one or more mooring ropes may de-stabilize the off-shore platform and/or cause it to drift slightly which may result in undesired forces or movement of the drilling casing or oil-recovery pipe. Thus, reacting to this immediate need, the inventors of the present invention developed a rope with a cut-resistant jacket that includes the weight/strength ratio desired for use for mooring the off-shore oil platforms, but is also configured to resist the cutting action of the trawl gear. Such a rope would constitute a substantial improvement to existing polyester mooring ropes.

Thus, there is a substantial need in the art for off-shore oil platform mooring ropes having both the desired strength to weight ration of polyester mooring rope, yet is configured to resist the cutting action when exposed to the dragged trawl gear.

SUMMARY OF THE INVENTION

The present invention is directed toward a rope having a cut-resistant jacket which overcomes the need in the art to have lightweight synthetic ropes which have an increased resistance to abrasion or cutting by trawl lines when used in deep-water mooring applications. The rope includes a core comprised of a plurality of sub-ropes. In one embodiment, the sub-ropes may be in a parallel strand configuration. In another embodiment, each sub-rope may comprise eight strands in a plaited construction. The sub-ropes and the strands thereof may be made of fibers of a synthetic material, such as polyester, nylon, polypropylene, polyethylene, aramids, or acrylics.

A cut-resistant jacket surrounds the core and is made from a material that has increased strength and/or abrasion resistance over the material of the core. In one embodiment, the cut-resistant jacket may comprise steel wires. In another embodiment, the cut-resistant jacket may comprise braided steel wires or rope. The braided steel wires or rope may be covered with a plastic material for increased corrosion resistance. A filter layer may be disposed between the core and the cut-resistant jacket wherein, in one embodiment, the filter layer may be wrapped around an outer surface of said core prior to the cut-resistant jacket being formed around the core and filter layer.

BRIEF DESCRIPTION OF THE SEVERAL VIEWS OF THE DRAWINGS

The accompanying drawings form a part of the specification and are to be read in conjunction therewith, in which like reference numerals are employed to indicate like or similar parts in the various views, and wherein.

DETAILED DESCRIPTION OF THE INVENTION

The following detailed description of the invention references the accompanying drawing figures that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and, therefore, the description is not to be taken in a limiting sense and shall not limit the scope of equivalents to which such claims are entitled.

Figure 1:
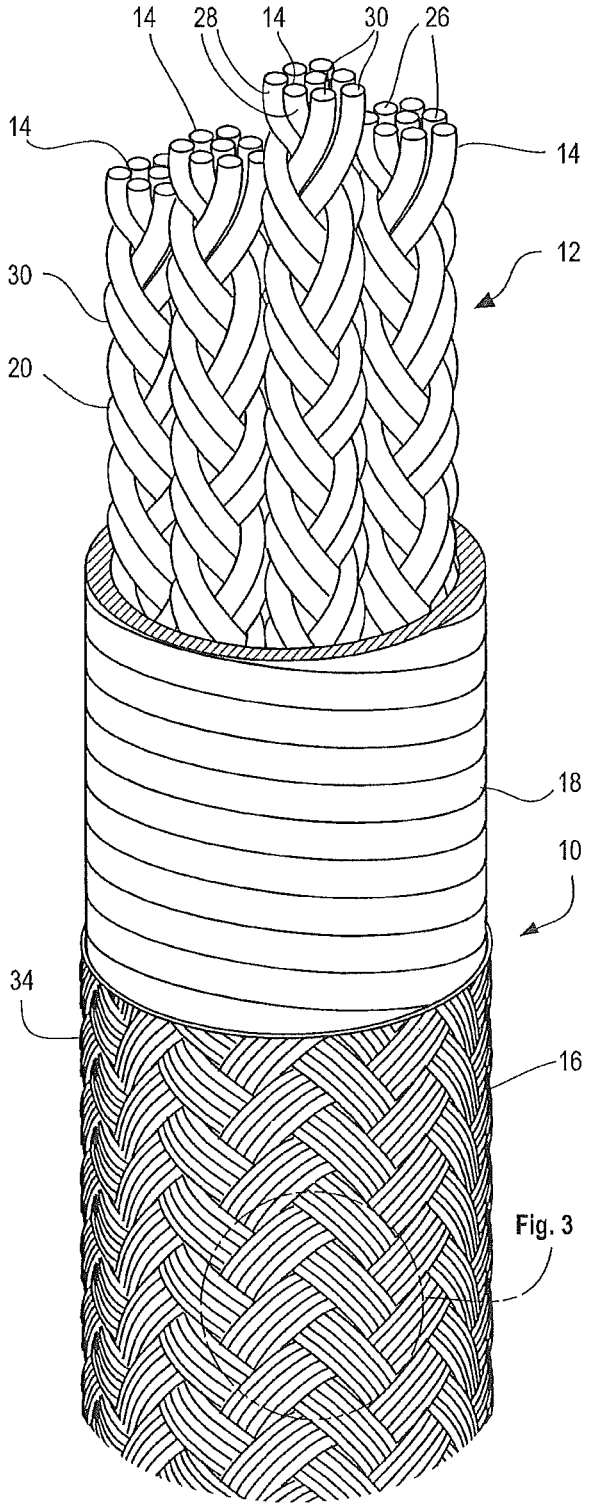
FIG. 1 is a perspective view of one embodiment of a rope with a cut-resistant jacket in accordance with the teachings of the present invention.
Figure 2:
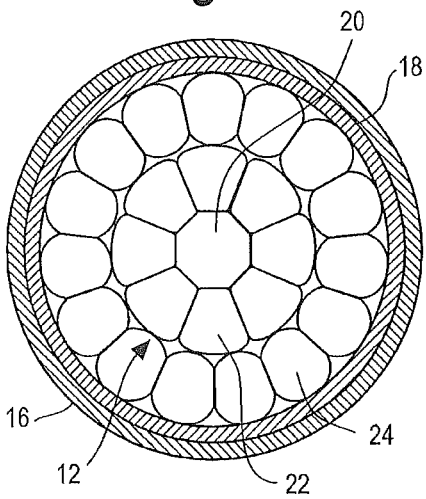
FIG. 2 is an end view of the embodiment of the cut-resistant jacket of the rope of FIG. 1.

As illustrated in FIG. 1, the present invention is directed toward a rope 10 having a core 12 comprised of a plurality of sub-ropes 14 and a cut-resistant jacket 16. As shown in FIGS. 1 and 2, an embodiment of rope 10 may also include a non-woven filter band 18 between core 12 and jacket 16.

As shown in FIG. 2, an embodiment of core 12 includes twenty-four (24) sub-ropes 14 arranged such that there is one (1) center sub-rope 20, eight (8) first layer sub-ropes 22 surrounding and contacting the center sub-rope 20, and fifteen (15) outer layer sub-ropes 24 surrounding and contacting one or more first layer sub-ropes 22. Synthetic rope may be used and one embodiment includes polyester sub-rope for its strength-to-weight ratio, with high-tenacity polyester being one preferred type. Other synthetic ropes, such as nylon, polypropylene, polyethylene, aramids, or acrylics may also be used. In addition to those specifically mentioned herein, any other rope material or combination thereof now known or hereafter developed may be used for the sub-ropes 14 comprising core 12.

As shown in FIG. 1, an embodiment of rope 10, each sub-rope 14 is an eight-strand plaited construction (4×2 strands) 26. Strands 26 may travel in pairs through the braiding wherein half of strands 26 are left lay strands 28 and half are right lay strands 30. Further, each strand 26 may have about eight-hundred forty (840) polyester textile yarns or fibers of 2222 dtex twisted in the opposite direction of the strand lay. Thus, if strand 26 is left lay 28, then the textile yarns or fibers are twisted in right direction and, if strand 26 is right lay 30, then the textile yarns or fibers are twisted in left direction. Table 1 below summarizes the strand and sub-rope components of one embodiment of the present invention.

TABLE 1

| Sub-rope Components | | | | | | |
|---|---|---|---|---|---|---|
| | Textile yarn | | | | | |
| | strand | | | Sub-rope | | |
| title dtex | #ends | diameter mm | lay length mm | #strands | diameter mm | braid pitch Mm |
| 2222 | 840 | 16.1 | 560 | 8 | 48.5 | 540 |

One embodiment of core 12 may include sub-ropes 14 being in a parallel strand rope configuration wherein all sub-ropes run parallel to each other and are not twisted or braided; however, core 12 may incorporate sub-ropes 14 being twisted or braided or in any other configuration now known or hereafter developed. However, core 12 is preferably torque-balanced.

Figure 3:
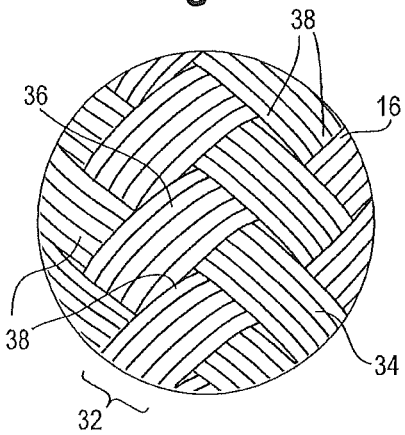
FIG. 3 is a close up side view of the embodiment of the cut-resistant jacket of the rope of FIG. 1.

As shown in FIG. 1, the cut-resistant jacket 16 surrounds core 12 and provides a protective covering to the tension carrying sub-ropes of core 12. One embodiment includes jacket 16 being a braided construction. However, a spiral wrapping or any other jacket pattern or configuration now known is within the scope of the present invention. As shown in FIGS. 1 and 3, a preferred embodiment includes jacket 16 being braided steel wires including thirty-two (32) braids 32 with sixteen (16) of them being left lay 34 and the other sixteen (16) being right lay 36 in order to torque balance rope 10 of the present invention.

FIG. 3 illustrates an embodiment of rope 10 of the present invention wherein cut-resistant jacket 16 has thirty-two (32) braids 32 and each braid includes five (5) strands 38, resulting in the total number of strands 38 comprising cut-resistant jacket 16 being one-hundred sixty (160). However, a person of skill in the art will appreciate that cut-resistant jacket 16 may have any number of strands per braid and any number of braids and numerous configurations are possible. The number of strands and braids may also vary and be dependent upon the diameter of the strands and/or the pitch of the braid. Strands 38 may be any material having an increased material strength and/or abrasion resistance over the material used for core 12. In one embodiment, cut-resistant jacket 16 is comprised of steel strands; however, any material now known or hereafter developed may be incorporated. For example, in addition to strands 38 being other metals including galvanized or stainless steel, strands 38 may be fiberglass, glass, monofilament or hollow threads of nylon, polypropylene, polyethylene, polyethylene, kevlar, aramids, acrylics, or any combination thereof. One embodiment may use a combination of polyethylene and steel strands to reduce weight. In addition to those specifically mentioned herein, any other material or combination having elevated abrasion resistance and the desired weight properties now known or hereafter developed may be used for the strands 38 comprising cut-resistant jacket 16. FIG. 3 illustrates a close up of the braiding pattern of strands 38 in one embodiment of cut-resistant jacket 16.

Another embodiment (not-shown) includes each strand 38 in cut-resistant jacket 16 being a steel wire rope having a plastic cover. In particular, this embodiment includes steel wire rope is a 6×7-CF, ordinary right lay wire rope having a tensile strength of 1770 N/mm$^2$ and which includes a six (6) strand twisted rope comprising strands of steel wires (one embodiment being (1+6)) having an outer plastic cover. In this embodiment, the diameter of the steel wire rope is 4 mm and the thickness of the cover is 1 mm, the diameter of the final steel wire rope is 6 mm. The plastic covering provides additional corrosion resistance over standard steel wires. However, stainless steel or other material having a natural or chemically created corrosion resistance may be also used. Table 2 below presents the specifications of one embodiment of the covered steel wire rope strands 38 and resulting rope used as an element in cut-resistant jacket 16.

TABLE 2

| Braided Jacket Strands | | | | | | | | |
|---|---|---|---|---|---|---|---|---|
| Jacket Rope Strand Specification | | | | | | Assembled Jacket Rope | | |
| inner wire | | outer wires | | strand | strand lay | steel rope | | with cover |
| # | diameter mm | # | diameter Mm | diameter mm | length mm | diameter mm | lay length mm | diameter mm |
| 1 | 0.45 | 6 | 0.45 | 1.35 | 13.28 | 4 | 28.1 | 6 |

To facilitate torque balancing, the lay length of the steel wire rope strand 38 in each braid 32 may be twisted in the opposite direction of the strand lay length. If the strand is a left lay strand, the steel wire rope may be a right lay length. If the strand is a right lay strand, the steel wire rope may be a left lay length. The parameters of a preferred embodiment of cut-resistant jacket 16 of the present invention are presented below in the Table 3.

TABLE 3

| Braided Jacket Components | | | |
|---|---|---|---|
| Number of braids | Number of strands per braid | The diameter of each strand, mm | The braid pitch, mm |
| 32 | 5 | 6 | 614 |

As shown in FIGS. 1 and 2, there may be disposed non-woven filter band 18 between core 12 and cut-resistant jacket 16. Non-woven filter band 18 may be configured to prevent particles having a size larger than about twenty micrometers (20 μm) from entering core 12. Particles of this size or above may result in abrasion of the sub-ropes 14 or may include living organisms that may attach to sub-ropes 14 and grow thereon causing deterioration, degradation or damage. One embodiment of filter band 18 includes filter band 18 being wrapped helically around core 12 as shown in FIG. 1. However, any configuration of filter band 18 is within the scope of the present invention. Filter band 18 may be any material now known or hereafter developed including synthetic woven or non-woven mats made of polymer, nylon, fiberglass, natural materials, or any other material known in the art.

Figure 4:
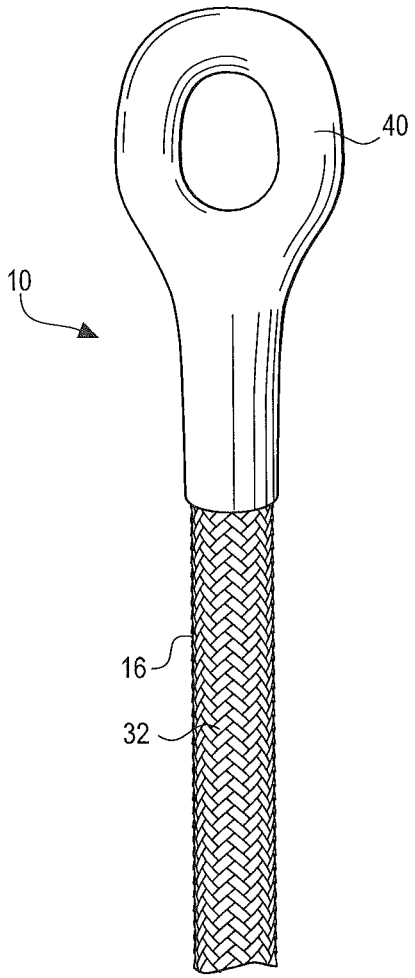
FIG. 4 is a perspective view of another embodiment of a rope the embodiment of a rope with a cut-resistant jacket in accordance with the teachings of the present invention.

FIG. 4 illustrates the completed rope 10 of the present invention including at least one termination configuration being an eye-loop 40. In one embodiment, eye-loop 40 is formed by the rope and each subrope is spliced on itself. However, a person of skill in the art will appreciate that any end termination configuration now known or hereafter developed may be attached onto the present rope 10 to facilitate a connection of the rope to an object as desired or required by a user.

Figure 5:
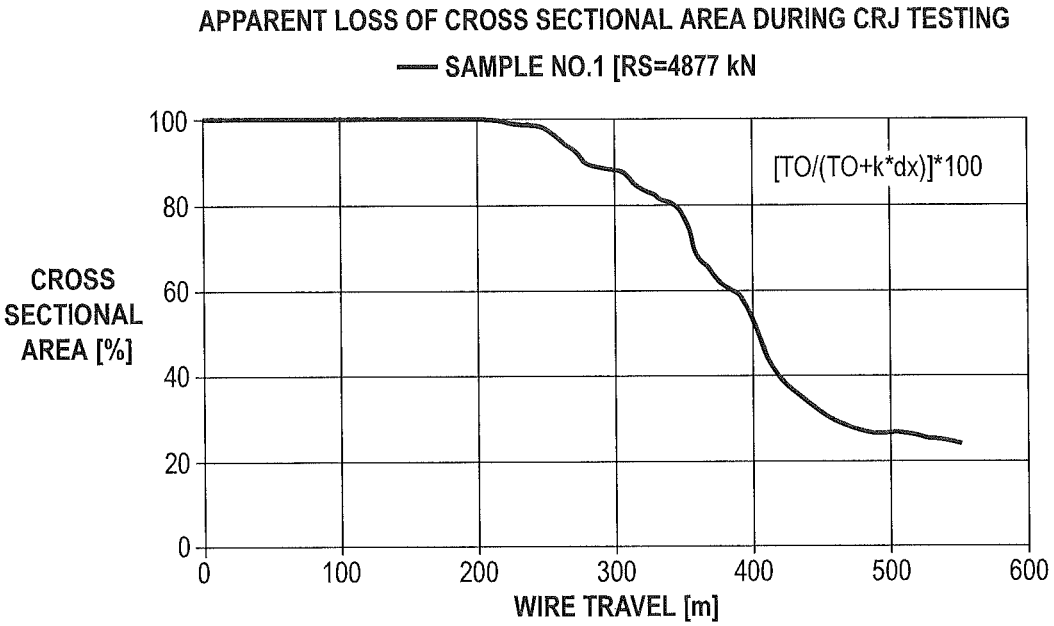
FIG. 5 is a graph of the apparent loss of cross-sectional area during an abrasion/cutting test of an embodiment of the rope of the present invention.
Figure 6:
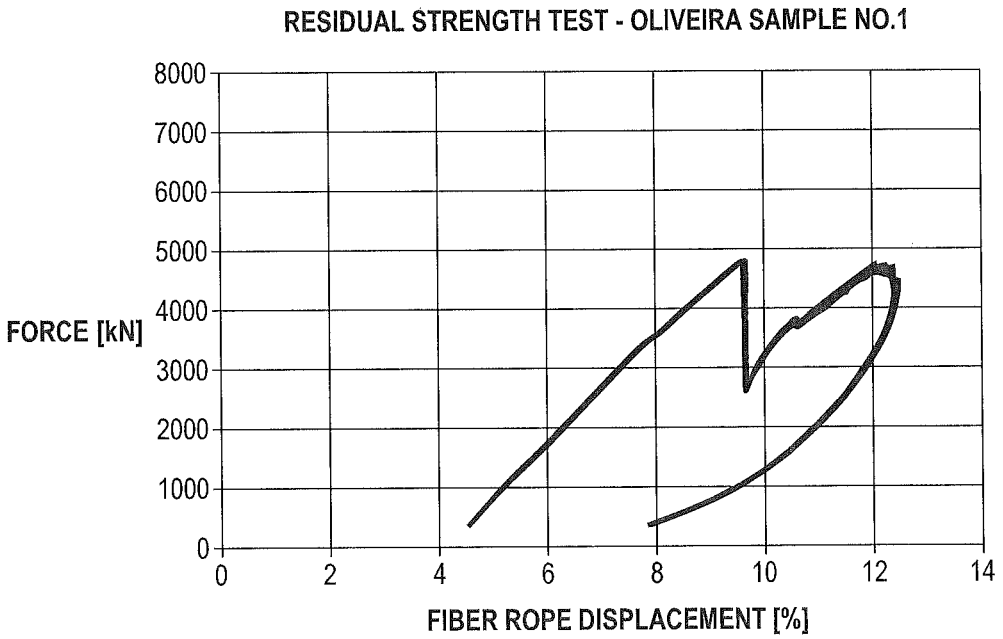
FIG. 6 is a graph of the force versus elongation of the embodiment of the rope tested in FIG. 5 after the abrasion/cutting test.

FIGS. 5 and 6 illustrate the test results of a two-part test to evaluate the capacity of the cut-resistant rope wherein the rope is first put through an abrasion/cutting test using a trawl steel wire rope to measure the apparent loss of cross sectional area in the rope as it is subject to abrasion from a trawl line. FIG. 5 illustrates the apparent loss in cross-sectional area for the length of travel of a trawl wire rope across one area of the present cut-resistant rope. Next, after the cross-sectional area of the present cut-resistant wire rope was reduced by cutting through a portion of the rope, the residual breaking force was measured through a pull test. FIG. 6 illustrates the residual strength test by comparing the pulling force applied to the rope and the measured displacement of the rope under tension. These tests were performed to evaluate the capacity of the cut resistant jacket of the rope to protect the load bearing core against the cutting action of a trawl steel wire rope.

As shown in FIG. 5, the calculated percentage of the effective cross sectional area versus length of travel of the cutting trawl steel wire rope is presented. FIG. 5 illustrates that until about two-hundred ten (210) meters of travel of trawl wire rope across the cut-resistant jacket, the cross-sectional area of the rope remains unchanged (at 100%), and after over five hundred (500) meters of travel across the cut-resistant rope, the cross sectional area was about twenty-five percent (25%) of the original cross-sectional area. FIG. 6 illustrates that the cut-resistant rope having about twenty-five percent (25%) of the original cross-sectional area was pulled until it broke. The residual breaking force was about four-thousand-eight-hundred-seventy-seven kilo-newtons (4877 kN). This strength corresponds to about twenty-four and nine-tenths percent (24.9%) of the minimum breaking force of the original rope.

The results of the tests show that one embodiment of the present cut-resistant rope has the ability to withstand up to about two-hundred (200) meters of a trawl line being drug across it without having any reduction in cross-sectional area or strength, or otherwise experiencing any damage. Further, the test results show that even with over five-hundred (500) meters of rope passing across the present cut-resistant rope, the resulting deep cut reduces the effective cross-sectional area to about one-fourth (¼) of the original area. Even with this reduction in area, the residual breaking force is still 24.9% of minimum breaking force of the original rope when new and undamaged. This shows that one embodiment of the present cut-resistant rope offers superior abrasion resistance and cut-resistance to a mooring line tied to an off-shore oil platform when it is subjected to abrasion by a commercial fishing trawl line. This solves an unsolved need in the industry.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

We claim:

1. A rope comprising:

a core comprised of a first material wherein said core comprises a plurality of sub-ropes, said plurality of sub-ropes comprising eight strands in a plaited construction; and a cut-resistant jacket comprised of a second material wherein said second material has a higher abrasion resistance than said first material.

2. The rope of claim 1 wherein half of said eight strands lay left and the other half of said eight strands lay right.

3. A rope comprising:

a core having a plurality of sub-ropes in a parallel strand configuration, each sub-rope comprising eight strands in a plaited construction, each strand comprising a plurality of fibers of a synthetic material;

a filter layer wrapped around an outer surface of said core; and a cut-resistant jacket surrounding said core and said filter layer, said cut-resistant jacket comprising braided steel wires.

4. The rope of claim 3 wherein half of said steel wires lay left and the other half of said steel wires lay right.

5. A rope comprising:

a core comprised of a first material wherein said core comprises a plurality of sub-ropes, said plurality of sub-ropes comprising eight strands in a braided construction; and a cut-resistant jacket comprised of a second material wherein said second material has a higher abrasion resistance than said first material.

6. The rope of claim 5 wherein half of said eight strands lay left and the other half of said eight strands lay right.

* * * * *